US006210130B1

(12) United States Patent
Kakuda et al.

(10) Patent No.: US 6,210,130 B1
(45) Date of Patent: Apr. 3, 2001

(54) ROTARY COMPRESSOR, REFRIGERATING CYCLE USING THE COMPRESSOR, AND REFRIGERATOR USING THE COMPRESSOR

(75) Inventors: Masayuki Kakuda; Eiji Watanabe; Yoshihide Ogawa; Minoru Ishii; Masao Tani; Munehisa Gunjima; Takashi Yamamoto; Susumu Kawaguchi, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/368,566

(22) Filed: Aug. 5, 1999

(30) Foreign Application Priority Data

Jun. 8, 1998 (JP) ..... 10-222759
Apr. 6, 1999 (JP) ..... 11-157550

(51) Int. Cl.[7] ..... F04B 17/00
(52) U.S. Cl. ..... 417/363
(58) Field of Search ..... 417/363, 410.3, 417/902; 418/66

(56) References Cited

U.S. PATENT DOCUMENTS 4,549,859 * 10/1985 Andrione ..... 417/363
4,744,737 * 5/1988 Yamamura et al. ..... 418/55
5,545,021 * 8/1996 Fukuoka ..... 418/66
5,564,916 * 10/1996 Yamamoto ..... 418/66

FOREIGN PATENT DOCUMENTS 34 44 389 8/1985 (DE) .
58-88485 6/1983 (EP) .
0 591 539 4/1994 (EP) .
0 600 131 6/1994 (EP) .
0 645 443 3/1995 (EP) .
0 752 532 1/1997 (EP) .
57-31593 6/1975 (JP) .
2502756 3/1996 (JP) .
10-47278 2/1998 (JP) .

OTHER PUBLICATIONS

"Fluid Machinery", JSME Mechanical Engineer's Handbook, Apr. 15, 1987, p. B5–159, Fig. 373 (with partial English translation).

* cited by examiner

*Primary Examiner*—Timothy S. Thorpe
*Assistant Examiner*—W Rodriguez
(74) *Attorney, Agent, or Firm*—Oblon, Spivak, McClelland, Maier & Neustadt, P.C.

(57) ABSTRACT

A rotary compressor having a piston provided integrally with a blade is contained in a hermetic vessel which is operated at a suction pressure of the rotary compressor and not to discharge pressure. The rotary compressor includes a compression mechanism portion having a cylinder which includes a suction port formed in a cylinder chamber, a piston which eccentrically revolves in the cylinder, a blade which is integrally formed with the piston and partitions the cylinder chamber into a high pressure chamber and a low pressure chamber, and a driving shaft for revolving the piston. The rotary compressor also includes an electric motor portion for rotating the driving shaft, a hermetic vessel which houses the compression mechanism portion and the electric motor portion and is in communication with the suction port thereby to maintain an interior of the hermetic vessel at a suction pressure atmosphere, and a discharge port formed in the cylinder chamber and in direct communication with an exterior of the hermetic vessel, whereby starting is smoothly performed, a motor having a large starting torque is not required, components such check valves can be avoided, and lubricating oils with stable viscosity can be used such that the compressor operates with environmentally-friendly refrigerants.

13 Claims, 12 Drawing Sheets

Pc > Pm > Ps

Pm > Pc
Pm > Ps

ROTARY COMPRESSOR, REFRIGERATING CYCLE USING THE COMPRESSOR, AND REFRIGERATOR USING THE COMPRESSOR

BACKGROUND OF THE INVENTION

1. Technical Field of the Invention

The present invention relates to a rotary compressor having a piston integrated with a blade, a refrigerating cycle of a refrigerating apparatus, an air conditioning apparatus, or the like using the compressor, and a refrigerator using the compressor.

2. Description of the Conventional Art

FIGS. 5 and 6 show a conventional rolling piston type rotary compressor (2-cylinder rotary compressor in the example) disclosed in, for example, Patent Publication No. 2502756. FIG. 5 is a longitudinal cross section of the rotary compressor and shows a refrigerating cycle. FIG. 6 is a transverse cross section of a compression mechanism portion of the rotary compressor. The description will be given hereinafter with reference to FIGS. 5 and 6. The conventional rotary compressor comprises an electric motor portion 50 having a stator 1 and a rotor 2 and a compression mechanism portion 60 which is driven by the electric motor portion 50 and has a frame 19, a cylinder 5 having a cylinder chamber 4 to which a suction port 3 and a discharge port (not shown) are opened, a partition panel 34 for partitioning the cylinder into two chambers, a cylinder head 20, a piston 8 rotatably fit on an eccentric shaft portion 7 of a driving shaft 6 and disposed in the cylinder 5, a vane 11 for partitioning the cylinder chamber 4 into a low pressure chamber 9 communicating with the suction port 3 and a high-pressure chamber 10 communicating with the discharge port (not shown), a vane spring 12 for urging the vane 11 against the piston side so that the valve 11 is not to be apart from the piston 8, and the driving shaft 6. The electric motor portion 50 and the compression mechanism portion 60 are directly mounted in a hermetic vessel 13 in which a discharge pressure atmosphere or a suction pressure atmosphere is kept, by means of welding, shrinkage fitting, or the like. FIG. 5 shows the case of using the discharge pressure atmosphere. The operation is performed in such a manner that the piston 8 revolves along the inner wall of the cylinder chamber 4 according to the rotation of the driving shaft 6, a compressible fluid such as a refrigerant gas sucked from the suction port 3 is compressed in association with the revolution, and the fluid is discharged from the discharge port (not shown).

FIG. 7 is a longitudinal cross section of a conventional blade-integrated piston type rotary compressor disclosed in, for example, Japanese Unexamined Patent Publication No. 10-047278 and FIG. 8 is a transverse cross section of a compression mechanism portion of the rotary compressor. In FIGS. 7 and 8, the compressor is comprised of an electric motor portion 50 having a stator 1 and a rotor 2 and a compression mechanism portion 60 driven by the electronic motor portion 50. The electric motor portion 50 and the compression mechanism portion 60 are housed in a hermetic vessel 13.

The compression mechanism portion 60 comprises a frame 19, a cylinder 5 having a cylinder chamber 4 to which a suction port 3 and a discharge port 14 are opened, a cylinder head 20, a piston 15*a* which is rotatably fit on an eccentric shaft portion 7 of a driving shaft 6 and disposed in the cylinder 5, a blade 15*b* provided integrally with the piston 15*a*, for partitioning the cylinder chamber 4 into a low pressure chamber 9 communicating with the suction port 3 and a high pressure chamber 10 communicating with the discharge port 14, a guide 17 which is rotatably fit in a cylindrical bore 16 formed in the cylinder 5 and slidably and swingably support the blade 15*b* and a driving shaft 6.

By the rotation of the driving shaft 6, the piston 15*a* revolves along the inner wall of the cylinder chamber 4 so as to swing as a fulcrum via the blade 15*b* on a rotation center 18 of the guide 17, the compressible fluid such as refrigerant gas sucked from the suction port 3 is compressed every revolution, and the fluid is discharged via the discharge port 14.

A structure similar to the blade-integrated piston type rotary compressor in which the piston and the blade are integrally formed and piston revolves eccentrically in the cylinder with aid of swinging motion is disclosed in FIG. 373 in page B5-159 and explanation for it in "Mechanical Engineer's Handbook" (issued by The Japan Society of Mechanical Engineers, Apr. 15, 1987).

In the conventional blade-integrated piston type rotary compressor, the electric motor portion 50 and the compression mechanism portion 60 are fixed in the hermetic vessel 13 by means of shrinkage fitting, welding, or the like and the discharge pressure atmosphere is kept in the hermetic vessel 13.

In the conventional rolling piston type rotary compressor, as described above, the compression mechanism portion comprises the cylinder 5, the piston 8, the vane 11, and the vane spring 12. In order to partition the cylinder space into the low pressure chamber 9 communicating with the suction port 3 and the high pressure chamber 10 communicating with the discharge port 14 by the piston 8 and the vane 11, it is necessary to make the tip of the vane 11 and the peripheral surface of the piston 8 always come into contact with each other with a right force. When the discharge pressure atmosphere is kept in the hermetic vessel 13, a force by the differential pressure between the compression chambers 9 and 10 and the hermetic vessel 13 acts in the direction of urging the vane 11 against the piston 8, so that the vane 11 can be pressed against the piston 8 by using the differential pressure. It is therefore sufficient to set the pressing force of the vane spring 12 to a smaller value by taking use of the differential pressure into account. In this case, in the compressor just before starting, a pressure is in a balanced state. Since the vane 11 is pressed against the piston 8 with a force which is smaller than the pressing force necessary in a steady operation by an amount of the differential pressure, an excessive load is not applied on the piston 8 and stable starting can be performed by a motor having the minimum starting torque.

On the contrary, during an off period of an ON/OFF operation performed by, for example, a compressor for refrigerator, the high-temperature high-pressure gas refrigerant in the hermetic vessel 13 is leaks from each of a contact surface 21 between the cylinder 5 and a frame 19, a contact surface 23 between the cylinder 5 and a cylinder head 20, and a contact surface 35 between the cylinder 5 and the partition panel 34 to the low pressure chamber 9 and a suction pipe 24 due to the pressure difference since the suction pressure is kept in a portion of the suction pipe 24, the suction port 3 and the low pressure chamber 9 in the cylinder 5 and the other portion in the hermetic vessel 13 is filled with the discharge pressure atmosphere. The leaking gas flows back from the suction pipe 24 to an evaporator 36 and a temperature rise tends to be caused in a condenser of a refrigerator or the like. In order to prevent this, a check valve or the like has to be installed between the suction pipe 24 and the evaporator 36, so that a problem of increased cost arises.

On the other hand, in case of using the structure such that the suction pressure atmosphere is kept in the hermetic vessel, the discharge pressure is kept in a portion of the high pressure chamber, the discharge portion, and the discharge pipe in the hermetic vessel and the other portion of the hermetic vessel is filled with the suction pressure atmosphere. A discharge valve provided on the discharge pipe side of the discharge port, however, plays the role of a check valve and separates the high-temperature high-pressure gas from the other. A leakage into the suction pressure portion does not occur during the off period of the ON/OFF operation and a gas does not flow back to the evaporator without providing the circuit with a check valve or the like.

When the rotary compressor has the construction such that the suction pressure atmosphere is kept in the hermetic vessel 13, a force by a differential pressure between the compression chamber and the hermetic vessel 13 is applied on the vane 11 in the direction of separating the vane 11 from the piston 8. It is therefore necessary to set a pressing force of the vane spring 12 for pressing the vane 11 against the piston 8 to a larger value by an amount of the maximum differential pressure within an assumable operation range, and the vane spring 12 having a pressing force larger than that in the case where the discharge pressure atmosphere is kept in the hermetic vessel 13. In a pressure balanced state just before starting, the pressing force of the vane spring 12 is not cancelled out by the differential pressure but is applied as it is, so that the vane 11 is pressed against the piston 8 by the force larger than the pressing force necessary during the steady operation. An excessive load is accordingly applied on the piston 8 and a motor having a large starting torque is necessary for starting.

When the motor is designed so as to have a large starting torque, the motor efficiency at the time of steady operation is sacrificed and the performance of the compressor therefore deteriorates. Since the pressing force of the vane spring is set to the maximum value within an assumable operating range, the vane cannot be pressed according to operating conditions (difference between suction and discharge pressures). Since the pressing force is always strong, the sliding condition between the tip of the vane and the peripheral surface of the piston is severe. The severe sliding condition causes not only wear of the vane tip but generation of sludge. Since such a construction that the suction pressure atmosphere is kept in the hermetic vessel is employed, there is such an inconvenience that generated sludge is exhausted through the discharge pipe to a circuit without being captured in the space in the hermetic vessel, and accumulated in the circuit to close a capillary tube.

In case of using HFC refrigerant such as R134, even if the discharge pressure atmosphere is kept in the hermetic vessel and the pressing force of the vane is reduced, an extreme-pressure effect as produced with a CFC refrigerant cannot be expected because of no chlorine atoms contained in the HFC refrigerant. The lubricity of the sliding portion consequently deteriorates and the sliding condition between the tip of the vane and the peripheral surface of the piston becomes severe.

On the other hand, according to the conventional blade-integrated piston type rotary compressor, the discharge pressure atmosphere is kept in the hermetic vessel 13 and the blade portion 15*b* corresponding to the vane is formed integrally with the piston 15*a*. Consequently, the pressing force is not applied on the piston 15*a* at the time of starting, stable starting can be always performed without setting the starting torque of the motor to an excessive value, and there is no inconvenience such as wear and sludge stack due to the sliding of the tip of the vane.

On the contrary, since the construction such that the discharge pressure atmosphere is kept in the hermetic vessel is used, in a manner similar to the rolling piston type rotary compressor using the discharge pressure atmosphere, the high-temperature high-pressure gas refrigerant in the hermetic vessel 13 flows back during an off period of operation from the high-pressure hermetic vessel 13 to the compression chamber, the suction pipe 24, and the evaporator 36 having a lower pressure through the contact surface 21 between the cylinder 5 and the frame 19 and the contact surface 23 between the cylinder 5 and the cylinder head 20 to raise the temperature of a condenser of a refrigerator or the like. Consequently, in order to prevent this, a check valve or the like has to be provided in a circuit between the suction pipe 24 and the evaporator 36 and there is a problem of increased cost.

When the compression mechanism portion and the electric motor portion are elastically supported in the hermetic vessel and a clearance is provided between both of the compression mechanism portion and the electric motor portion and the hermetic vessel inner wall, it is necessary to isolate and seal a portion between a pipe attached to the hermetic vessel and the compression mechanism portion on either of the discharge side or the suction side. In the case where the discharge pressure atmosphere is kept in the hermetic vessel, the suction pipe attached to the hermetic vessel is laid in the hermetic vessel, so that the portion of the suction pipe attached to the hermetic vessel and the suction port of the compression mechanism portion cylinder is sealed from the discharge pressure in the hermetic vessel so as to maintain the suction pressure. In the case where the suction pressure atmosphere is kept in the hermetic vessel, it is also necessary to lay the discharge pipe attached to the hermetic vessel so as to maintain the discharge pressure by sealing the portion between the discharge pipe and the discharge port of the compression mechanism portion cylinder. The pipe laid in the hermetic vessel has to be designed with low rigidity so as not to be deformed, fatigued, or damaged by the vibration of the compression mechanism portion and the electronic motor portion which are elastically supported in the hermetic vessel. Since the volume flow rate of gas in the suction pipe portion through which gas before compression flows is higher than that in the discharge pipe portion through which compressed gas flows and the flow velocity of the gas in the suction pipe portion is faster than that in the discharge pipe portion, the pipe diameter of the suction pipe portion cannot be reduced from the viewpoint of pressure loss. It cannot be therefore said that the laying of the suction pipe is a realistic choice. That is, when the electric motor portion is elastically supported in the hermetic vessel and the discharge pressure atmosphere is kept in the hermetic vessel, such a problem is caused that the pressure loss in the suction pipe laid in the hermetic vessel becomes large in order to prevent deformation and damage.

Therefore, the electric motor portion 50 and the compression mechanism portion 60 are directly attached to the hermetic vessel 13 in the construction where the discharge pressure atmosphere is kept in the hermetic vessel. As a result, vibration and noise in the compressor are directly transmitted to the outside so that low vibration and low noise cannot be always achieved. In order to reduce the vibration transmitted from the compressor to the piping system constructing a refrigerating cycle of a refrigerator or the like and to prevent the pipe from being damaged due to deformation caused by the transmitted vibration, it is necessary to form the piping to the compressor with a small diameter and a long movable portion. As a result, the efficiency is reduced by the pressure loss, costs are increased due to complication of the piping and, further, the piping design becomes complicated.

Moreover, when the discharge pressure atmosphere is kept in the hermetic vessel 13, the force by the differential pressure applied on the guide 17 is applied concentratedly on a narrow flat sliding portion between the guide 17 and the blade 15*b*. The sliding loss therefore increases and the reliability deteriorates.

Irrespective whether the vane (blade) is integral with the piston or not, the space 5*a* in which the vane (blade) moves is generally opened in the space in the hermetic vessel 13 as shown in FIG. 9A and the pressure therein is usually equalized. When the space is sealed as shown in FIG. 9B, the vane (blade) goes in and out from the closed space 5*a*. Since an increased or decreased space volume due to the movement of the vane (blade) causes a loss, it is preferable to open the space 5*a* to the space in the hermetic vessel 13 irrespective whether the discharge pressure atmosphere or the suction pressure atmosphere is kept in the hermetic vessel 13.

In the case of using a blade-integrated type 2-cylinder construction, increase or decrease of volume in the space 5*a* in which two blades move is cancelled out. Although it is therefore possible not to open the space 5*a* to the hermetic vessel, there is a problem that the behavior of the guide becomes unstable. As shown in FIGS. 10A and 10B, the curvature of the cylindrical surface of the guide 17 and the curvature of the cylindrical bore portion 16 in which the guide is fit are not equal and have to have a small curvature difference from the viewpoint of assembling performance, slidability, and the like. A supporting point S at which the guide 17 comes into contact with the cylindrical bore is determined by the balance of forces applied to the guide 17. When the space 5*a* in which the blade moves is not opened to the hermetic vessel, the pressure in the space is equal to an intermediate pressure Pm between a suction pressure Ps and a discharge pressure Pd due to the leakage between the compression chambers 9 and 10. The supporting point of the guide on the discharge side is a point near the inner circumference of the cylinder as shown in FIG. 10A when the pressure Pc in the high pressure chamber 10 is lower than Pm. When the compression develops and the pressure Pc in the high pressure chamber 10 increases to a value higher than Pm, the supporting point comes to a point near the blade moving space as shown in FIG. 10B. As mentioned above, since the supporting point is not fixed and becomes unstable at the moment when the supporting point is moving between the state of FIG. 10A and the state of FIG. 10B, there is a problem of slidability and reliability of the guide 17.

When the blade moving space 5*a* is opened to the hermetic vessel 13, both of the loss due to the increase or decrease of volume in the blade moving space and the instability of the guide supporting point can be avoided. When the hermetic vessel 13 has therein the discharge pressure, as shown in FIG. 11, the pressure in the blade moving space 5*a* becomes the discharge pressure Pd, supporting points S and S' of the guide 17 are near the cylinder inner circumference and loads $F_3$ and $F_3'$ between flat portions of the guide and side surfaces of the blade are applied concentratedly to a narrow portion near the cylinder inner circumference, so that the sliding loss increases and the reliability deteriorates.

Further, in the case where the discharge pressure atmosphere is kept in the hermetic vessel 13, the discharge pressure portion in the circuit volume during the operation increases corresponding to an increased space with high pressure in the hermetic vessel and an oil stored in the hermetic vessel is exposed to the discharge pressure, so that the amount of refrigerant dissolved in the oil increases more than that in the suction pressure atmosphere, and the amount of refrigerant enclosed in the circuit increases consequently. It is therefore undesirable from the viewpoint of safety from catching fire and explosion to use a combustible refrigerant such as hydrocarbon refrigerant (HC refrigerant). From the viewpoint of suppressing the enclosed refrigerant amount, it is desirable that the space volume in the hermetic vessel is as small as possible. However, in the reciprocating type compressor in which the suction pressure atmosphere is kept in the hermetic vessel, as shown in FIG. 12, since the piston 15*a* and the cylinder 5 are disposed on only one side with respect to the center of the motors 1 and 2 and the driving shaft 6 and the construction is asymmetrical, the section having no compression mechanism portion causes increase of the space volume.

SUMMARY OF THE INVENTION

The present invention has been achieved to solve the problems of the conventional technique and it is an object to obtain a very reliable highefficient blade-integrated piston type rotary compressor in which stable starting can be always performed without using a motor of an excessive starting torque, a high-temperature high-pressure gas refrigerant can be prevented from flowing back to a condenser during an off period of ON/OFF operation without installing a check valve or the like in the circuit, the suction pipe is not damaged or broken, noise can be reduced by preventing direct transmission of vibration and noise occurring in the compressor to the outside, an HFC refrigerant which is not connected with ozone layer destruction can be used as a refrigerant to use, the safety from catching fire and explosion is enhanced even when a combustible refrigerant such as hydrocarbon refrigerant which does not exert an adverse influence on the global environment is used, occurrence of sludge and deposition of the sludge in the circuit caused by a severe sliding portion are prevented, and the sliding loss of the blade does not increase.

It is another object to obtain a refrigerating cycle to take advantage of the characteristics of the compressor by using the compressor.

It is further another object to obtain a refrigerator to take advantage of the characteristics of the compressor by using the compressor.

According to a first aspect of the present invention, there is provided a rotary compressor comprising: a compression mechanism portion having a cylinder which includes a suction port and a discharge port formed in a cylinder chamber, a piston which eccentrically revolves in the cylinder, a blade which is integrally formed with the piston and partitions the cylinder chamber into a high pressure chamber and a low pressure chamber, and a driving shaft for revolving the piston; an electric motor portion for rotating the driving shaft; and a hermetic vessel for housing the compression mechanism portion and the electric motor portion, wherein a suction pressure atmosphere is kept in the hermetic vessel for housing the compression mechanism portion and the electric motor portion.

A rotary compressor according to a second aspect of the present invention relates to the first aspect, wherein the compression mechanism portion and the electric motor portion are held in the hermetic vessel by an elastic supporting member, a clearance is provided between the compression mechanism portion and the inner wall of the hermetic vessel and a clearance is provided between the electric motor portion and the inner wall of the hermetic vessel.

A rotary compressor according to a third aspect of the present invention relates to the first or second aspect, wherein a refrigerant used is an HFC refrigerant.

A rotary compressor according to a fourth aspect of the present invention relates to the third aspect, wherein a lubricating oil which is not miscible with or is slightly miscible with the HFC refrigerant is enclosed in the hermetic vessel.

A rotary compressor according to a fifth aspect of the present invention relates to the first or second aspect, wherein a refrigerant used is a hydrocarbon refrigerant.

A rotary compressor according to a sixth aspect of the present invention relates to the fifth aspect, wherein a lubricating oil which is not miscible with or is slightly miscible with the hydrocarbon refrigerant is enclosed in the hermetic vessel.

A rotary compressor according to a seventh aspect of the present invention relates to the third aspect, wherein a lubricating oil which is miscible with the HFC refrigerant is enclosed in the hermetic vessel.

A rotary compressor according to a eighth aspect of the present invention relates to the fifth aspect, wherein a lubricating oil which is miscible with the hydrocarbon refrigerant is enclosed in the hermetic vessel.

In a refrigerating cycle according to a ninth aspect of the present invention comprising a compressor, an evaporator, a decompressor, and a condenser, the rotary compressor according to any one of the first to eighth aspects is used as the compressor.

In a refrigerator according to a tenth aspect of the present invention comprising a compressor, an evaporator, a decompressor, and a condenser, the rotary compressor according to any one of the first to eighth aspects is used as the compressor.

According to the first aspect of present invention, the high-temperature high-pressure gas refrigerant does not flow back from the contact surface between the cylinder and the frame and the contact surface between the cylinder and the cylinder head to the low pressure side on which the evaporator exists, and a temperature rise in the condenser during an off period of operation can be prevented without installing a check valve or the like in the circuit.

A reciprocating type compressor is another example of such a compressor in which a suction pressure atmosphere is kept in the hermetic vessel, a back flow of a high-temperature high-pressure gas refrigerant to the lower pressure side on which the evaporator exists is prevented, and a temperature rise in the condenser during an off period of operation is avoided without installing a check valve or the like in the circuit. However, the efficiency of the rotary type compressor is higher than that of the reciprocating type compressor with respect to the compression mechanism.

Though the suction pressure is formed in the hermetic vessel, a problem at starting time due to a large pressing force of the vane spring as essentially included in the rolling piston type rotary compressor does not occur because of an integrated structure of the blade with the piston. That is, a motor having a large starting torque is not required so that the efficiency of the motor is not therefore limited.

Wear and generation of sludge caused by a severe sliding between the tip of the vane and the piston peripheral surface due to a large pressing force of the vane spring can be prevented, so that exhaust of the sludge to or deposition of the sludge in the refrigerating circuit is not caused.

Since the blade and the piston are formed integrally and the suction pressure atmosphere is kept in the hermetic vessel, concentration of loads applied on the blade side faces when sliding can be avoided so that an increase of the sliding loss caused by the blade sliding can be prevented. Thus, a rotary compressor with high-reliability and high-efficiency can be obtained.

As mentioned above, in the rotary compressor according to the first aspect of the present invention, the suction pressure atmosphere is kept in the hermetic vessel and the blade is integrated with the piston. Consequently, the vane spring for pressing the vane against the piston is unnecessary. While avoiding unsmooth starting due to an excessive pressing force of the vane spring or reduction in the motor efficiency caused by an increase in the starting torque, the severe conditioned sliding portion between the tip of the vane and the piston peripheral surface is eliminated without sacrificing the high efficiency inherent to the rotary type compressor and generation of sludge, its inflow to the circuit and its deposition can be suppressed. Further, leakage of a high-pressure gas to the evaporator side during an off period of operation can be avoided without installing a check valve or the like in the circuit and, further, the sliding loss of the blade can be reduced.

A very reliable rotary compressor can be therefore obtained without sacrificing the high efficiency inherent to the rotary type compressor.

According to the second aspect of the present invention, the vibration of the compressor is absorbed by the elastic supporting member so as to be hardly transmitted to the outside, thereby enabling noise and vibration to be lowered without sacrificing the efficiency inherent to the rotary type. The vibration transmitted from the compressor to the piping system constituting the refrigerating cycle of a refrigerator or the like can be reduced. In the case where the electric motor portion and the compression mechanism portion are directly attached to the hermetic vessel the piping to the compressor is so formed as to have a small diameter and a long movable portion in order to prevent the piping from being deformed or damaged by the vibration transmitted to the piping system from a compressor having large vibration. Since the vibration transmitted to the outside is reduced according to the present invention, however, the above arrangement does not have to be made, so that reduction in efficiency caused by pressure loss, increase in cost due to complication of the piping and, further, complicated pipe design are all avoided.

Since not the discharge pressure atmosphere but the suction pressure atmosphere is kept in the hermetic vessel, it is unnecessary to lay the suction pipe in the hermetic vessel even in the case where the compression mechanism portion and the electric motor portion are elastically supported in the hermetic vessel. As a result, a problem of an increase in the pressure loss caused by reduction in rigidity to avoid deformation and damage of the suction pipe by the vibration in the compressor can be solved.

Therefore, a low-period rotary compressor with low-noise, low-vibration and high-efficiency can be obtained, taking advantage of the characteristics of the efficient rotary compressor.

According to the third aspect of the present invention, the extreme-pressure effect cannot be expected since the refrigerant does not contain chlorine. However, as the vane and the piston are formed integrally, there is no severe conditioned sliding between the tip of the vane and the piston peripheral surface which appears in the conventional rotary compressor used with the HFC refrigerant, so that the generation, inflow to the circuit and deposition, of sludge can be suppressed. In a reciprocating type compressor, if R134a or the like of which the volume flow rate is more than that of R12 having an equivalent capability is used, a suction pressure loss occurs due to a suction valve. However, this can be suppressed since the suction valve is not used in the third aspect of the present invention. By these effects, while using an HFC refrigerant which is not connected with ozone layer destruction, a very reliable long-life rotary compressor can be obtained without sacrificing the high efficiency inherent to the rotary type compressor.

According to the fourth aspect of the present invention, since the refrigerant does not dissolve in the lubricating oil, the lubricating oil having a stable viscosity can be supplied to the sliding portion so that abnormal wear, burning, and the like do not easily occur in the sliding portion. Thus, a very reliable long-life rotary compressor affecting no ozone layer destruction can be obtained without sacrificing the high efficiency inherent to the rotary type compressor.

According to the fifth aspect of the present invention, the discharge pressure portion in the total volume of the circuit during operation is decreased by an amount corresponding to the space of the hermetic vessel, and the amount of refrigerant dissolved in the oil stored in the hermetic vessel is decreased because of the suction pressure atmosphere in the vessel. Therefore, the initial enclosing amount of the refrigerant can be decreased as compared with the compressor with the discharge pressure atmosphere. Even if the enclosed refrigerant is leaked out into a room or the like, it does not easily reach the explosion limit so that safety is assured more. In the reciprocating type compressor, the compression mechanism portion is asymmetrical though the suction pressure atmosphere is kept in the hermetic vessel. In the blade-integrated piston type rotary compressor on the other hand, the space volume in the hermetic vessel can be suppressed more because the compression mechanism portion is disposed symmetrically. The blade-integrated piston type rotary compressor is further advantageous from the viewpoint of reduction in the enclosed refrigerant amount. In the reciprocating type compressor, if a hydrocarbon refrigerant R600a or the like of which the volume flow rate is more than that of RB4a having the equivalent capability is used, a suction loss occurs due to a suction valve. However, this can be suppressed since the suction valve is not used in the fifth aspect of the present invention. By these effects, a very reliable long-life rotary compressor can be obtained without sacrificing high efficiency inherent to the rotary type compressor while safely using a hydrocarbon refrigerant which is not connected to ozone layer destruction and global warming, but not using a CFC refrigerant or an HCFC refrigerant containing chlorine as a substance which destructs the ozone layer or a HFC refrigerant having a high global warming coefficient.

According to the sixth aspect of the present invention, since the refrigerant does not dissolve in the lubricating oil, the lubricating oil having a stable viscosity can be supplied to the sliding portion so that abnormal wear, burning, and the like do not easily occur in the sliding portion. Consequently, a very reliable long-life rotary compressor which does not exert an adverse influence on the global environment by affecting the ozone layer destruction, global warming and the like, without sacrificing the high efficiency inherent to the rotary type can be obtained.

According to the seventh or eighth aspect of the present invention, lack of the lubricating oil is not brought about since returnability of the miscible lubricating oil circulating in the circuit is more excellent than that of a non-miscible lubricating oil, so that the lubricating oil is stably supplied to the sliding portion and abnormal wear, burning and the like do not easily occur in the sliding portion. In case of a low pressure hermetic vessel, as gas after compression is directly discharged to the circuit without being released into the hermetic vessel once and the quantity of the lubricating oil flowing out is not kept down at an extremely low level, an effect of sealing gaps by the oil in the compression chamber can be expected. Thus, a very reliable long-life rotary compressor affecting no ozone layer destruction can be obtained without sacrificing the high efficiency inherent to the rotary compressor.

According to the ninth or tenth aspect of the present invention, a refrigerating or air-conditioning apparatus selected from the following apparatuses having the effects corresponding to any of the constructions of the present invention can be obtained: a low-priced and very efficient refrigerating or air-conditioning apparatus in which back flow of a high-pressure gas refrigerant to a low pressure side during an off period of operation is prevented to avoid temperature rise of a condenser, without installing a check valve or the like in a refrigerating circuit of the apparatus; a very efficient and highly reliable refrigerating or air-conditioning apparatus in which a vane and a piston are integrally formed so that unsmooth starting caused by an excessive pressing force of a vane spring or decrease in motor efficiency caused by a largely set starting torque is avoided; a highly reliable refrigerating or air-conditioning apparatus in which generation, inflow to the circuit and deposition, of sludge are suppressed since there is no severe conditioned sliding between the tip of the vane and the peripheral surface of the piston; a low-priced and very efficient refrigerating or air-conditioning apparatus with low-vibration and low-noise in which the electric motor portion and the compression mechanism portion are elastically supported in the hermetic vessel so that vibration generated in an electric motor portion and compression mechanism portion is hardly transmitted to the outside, resulting in lower vibration and lower noise of the compressor, unnecessary complicated piping around the compressor, and less decrease in efficiency caused by a pressure loss because of a simplified piping; a high-reliable long-life refrigerating or air-conditioning apparatus without causing the ozone layer destruction in which generation, inflow to the circuit and deposition, of sludge can be suppressed even in the case of using HFC refrigerant such as R134a containing no chlorine and producing no extreme-pressure effect because there is no severe conditioned sliding portion; a refrigerating or air-conditioning apparatus without causing the ozone layer destruction and global warming, in which since the suction pressure atmosphere is kept in the hermetic vessel, an initial enclosing amount of the refrigerant can be reduced without sacrificing the high-efficiency inherent to the rotary type so that a hydrocarbon refrigerant can be used safely; a high-reliable long-life refrigerating or air-conditioning apparatus in which the refrigerant does not dissolve in the lubricating oil so that the lubricating oil having a stable viscosity is supplied to the sliding portion to prevent abnormal wear, burning, and the like from occurring in the sliding portion easily; and a high reliable long-life refrigerating or air-conditioning apparatus in which refrigerant is miscible with the lubricating oil so that the lubricating oil is stably supplied to the sliding portion to prevent abnormal wear, burning and the like from occurring in the sliding portion easily.

DETAILED DESCRIPTION OF THE PREFERRED EMBODIMENTS

Embodiment 1

Figure 1:
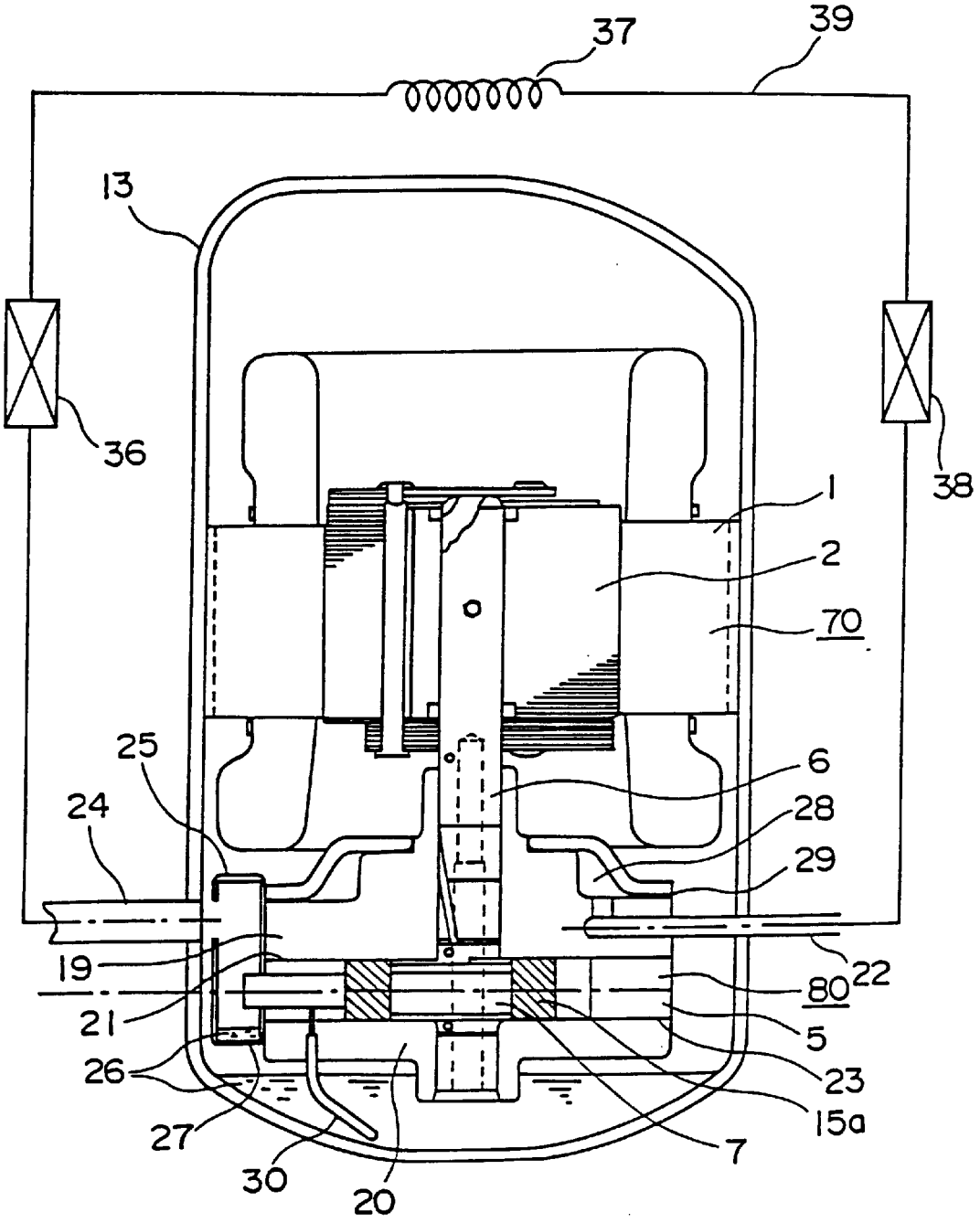
FIG. 1 shows a longitudinal cross section of a rotary compressor in Embodiment 1 of the present invention and a diagram of a refrigerating cycle.
Figure 2:
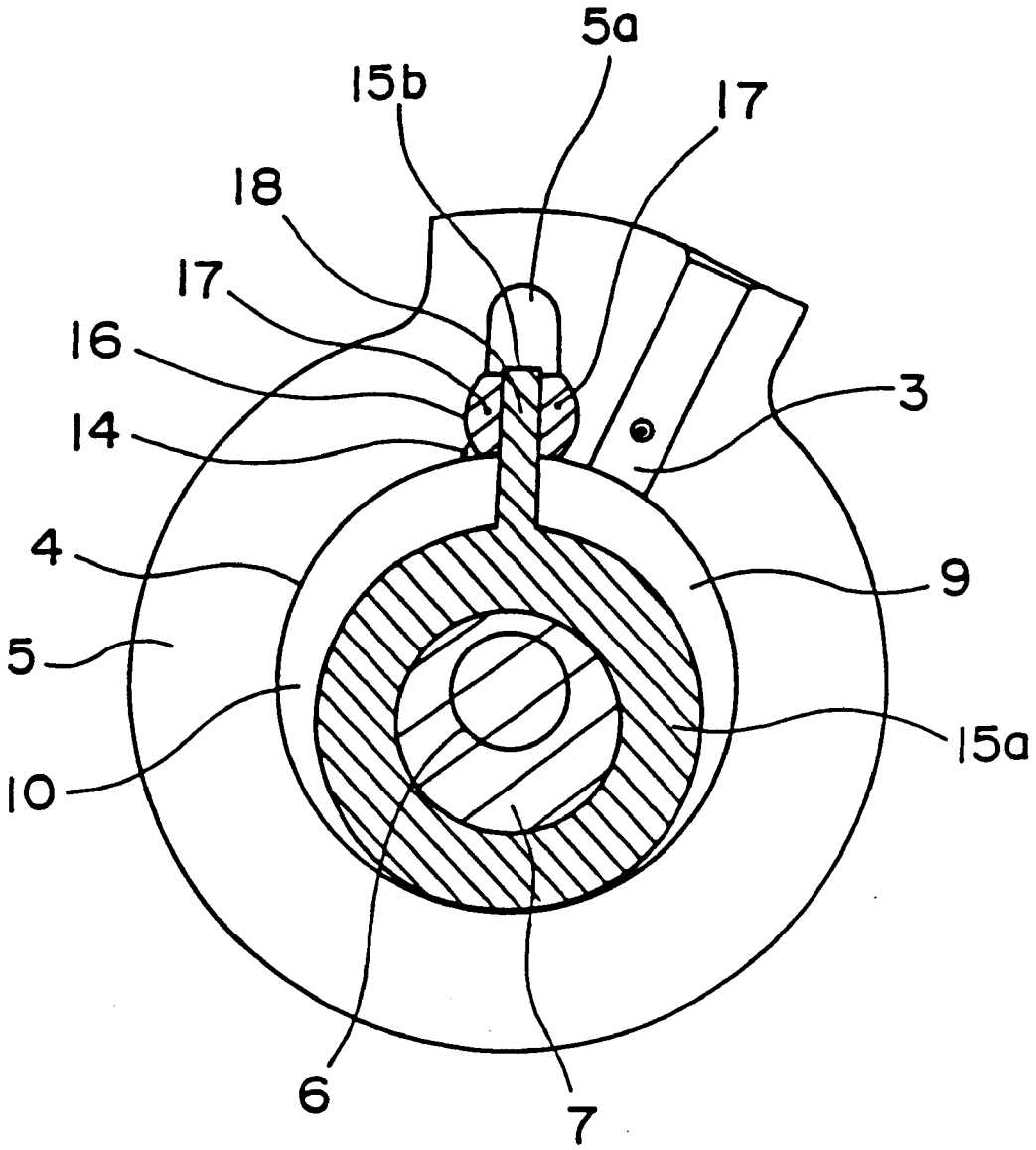
FIG. 2 shows a transverse cross section of a compression mechanism portion of the rotary compressor in Embodiment 1 of the present invention.

FIG. 1 is a longitudinal cross section of a blade-integrated piston type rotary compressor according to an embodiment of the present invention and shows a refrigerating cycle. FIG. 2 is a transverse cross section showing a compression mechanism portion of the compressor.

In the diagrams, a blade-integrated piston type rotary compressor comprises: an electric motor portion 70 having a stator 1 and a rotor 2; and a compression mechanism portion 80 which is driven by the electric motor portion 70. The compression mechanism portion 80 has a cylinder 5 having a cylinder chamber 4 to which a suction port 3 and a discharge port 14 are opened, a piston 15*a* which is rotatably fit on an eccentric shaft portion 7 of a driving shaft 6 and is disposed in the cylinder 5, a blade 15*b* which is integrally provided with the piston 15*a* and partitions the cylinder chamber 4 into a low pressure chamber 9 as a compression chamber communicating with the suction port 3 and a high pressure chamber 10 as a compression chamber communicating with the discharge port 14, and a guide 17 which is rotatably fit in a cylindrical bore 16 formed in the cylinder 5 and slidably and swingably supports the blade 15*b*. The piston 15*a* revolves along the inner wall of the cylinder chamber 4 in accordance with the rotation of the driving shaft 6 so as to swing as a fulcrum via the blade 15*b* on an axis position 18 of the guide 17 via the blade 15*b*. A refrigerant gas sucked through the suction port 3 is compressed every revolution and discharged via the discharge port 14.

Figure 9B:
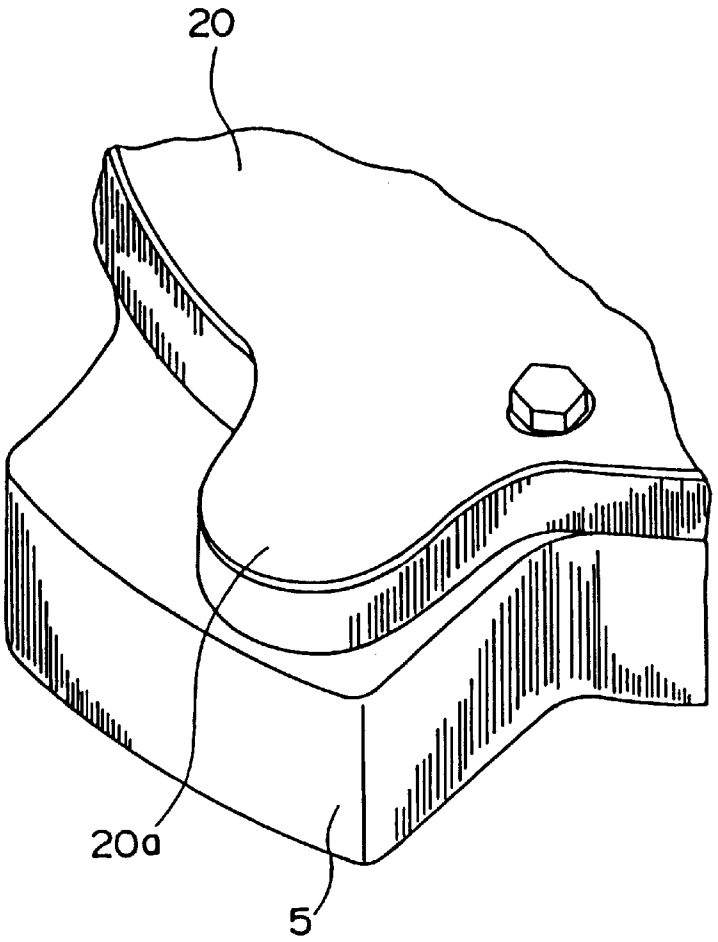
FIG. 9B shows a perspective views from a cylinder head side with respect to a case where the blade moving space is not opened to the hermetic vessel.
Figure 9A:
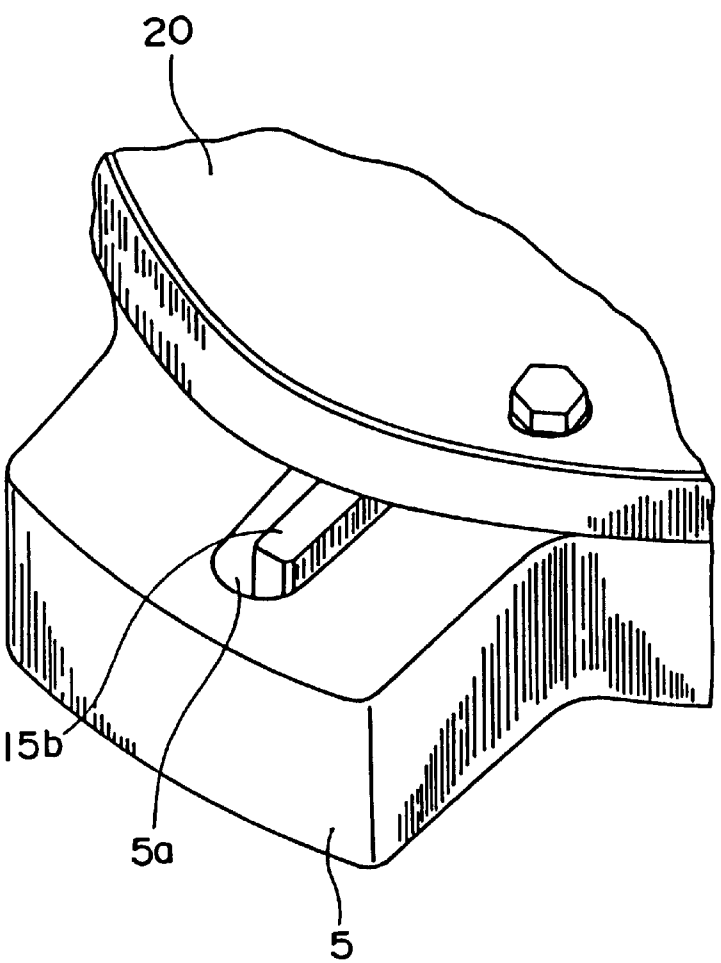
FIG. 9A shows a perspective views from a cylinder head side with respect to a case where the blade moving space is opened to a hermetic vessel.
Figure 10B:
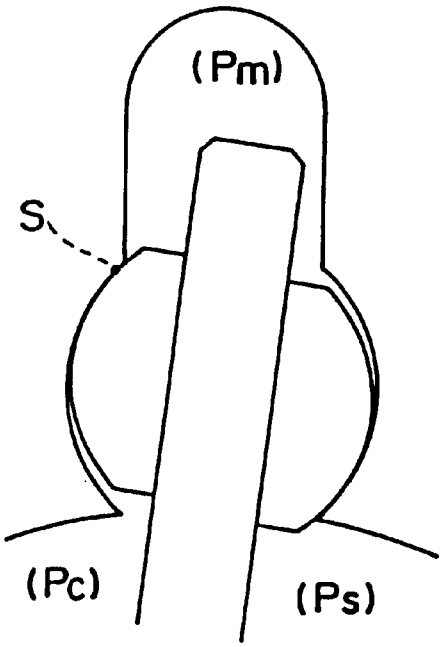
FIGS. 10A and 10B show schematic diagrams showing the relation of forces applied on a guide when the blade moving space is not opened to the hermetic vessel.
Figure 10A:
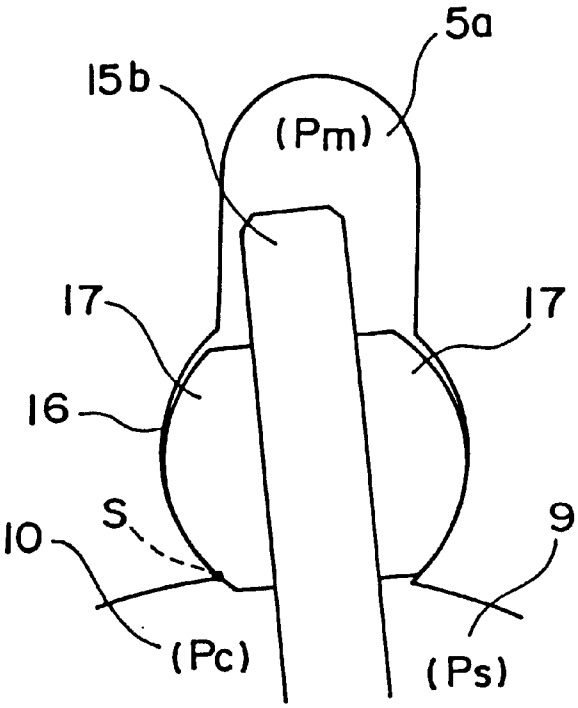

The blade moving space 5*a* in which a tip portion of the blade 15*b* swings is opened to the space in the hermetic vessel 13 as shown in FIG. 9A or allowed to communicate with the space in the hermetic vessel 13 through a communication hole, and an oil storing space is formed in the space 5 so that the blade 15*b* and the guide 17 can slide and oil sealing can be performed. The lubricating oil to the oil storing space is supplied by an injector pipe 30 which will be described hereinafter via the suction port 3, the compression chambers 9 and 10 and a clearance between the cylinder 5 and the frame 19 and a clearance between the cylinder 5 and the cylinder head 20. When the blade 15*b* moves in the direction of compressing the lubricating oil and the refrigerant in the space in the blade moving space 5*a*, the blade moving space Sa is opened to the space in the hermetic vessel 13 as shown in FIG. 9A or allowed to communicate with the space in the hermetic vessel 13 through a communication hole so that the lubricating oil and refrigerant are exhausted in order to make the blade move smoothly. Since the suction pressure atmosphere is kept in the hermetic vessel 13, the lubricating oil and the like can be easily exhausted sliding and swinging motion of the blade 15*b* can be smoothly performed.

In FIG. 1, the refrigerant gas flowed through the suction pipe 24 is separated into a refrigerant gas and a lubricating oil 26 by a suction muffler 25 for suppressing the pulsation of the sucked gas. The separated lubricating oil 26 is returned via a bore 27 opened in the lower portion of the suction muffler 25 to the oil storing portion in the lower portion of the hermetic vessel 13 and the refrigerant gas passes through a pipe leading to the suction port 3 and is taken via the suction port 3 into the compression chamber 9 in the low pressure. The refrigerant gas compressed in the compression chamber is discharged via the discharge port 14, the pulsation of the refrigerant gas is suppressed by a discharge muffler 28 for suppressing the pressure pulsation and the refrigerant gas is discharged to a discharge pipe 22. Lubricating oil 26 separated in the discharge muffler 28 is returned via a fine bore 29 opened in the lower portion of the discharge muffler 28 to the oil storing portion.

The refrigerant gas flowing from the suction pipe 24 passes through a suction route (suction muffler 25 and other) and reaches the suction port 3. A pressure loss occurs when the refrigerant gas passes through the suction route. The pressure in the hermetic vessel 13 is therefore higher than that at the suction port 3. The injector pipe 30 for supplying the lubricating oil 26 by using the differential pressure between the compression chamber and the hermetic vessel 13 is attached to the suction port 3. The lubricating oil flowing from the injector pipe 30 into the compression chamber is supplied to the contact surface 21 between the cylinder 5 and the frame 19 and the contact surface 23 between the cylinder 5 and the cylinder head 20, so that the sealing performance of the contact surfaces is enhanced.

The oil is supplied from the oil storing portion in the lower portion of the hermetic vessel 13 to bearing portions of the frame 19 and the cylinder head 20 as bearing portions for the driving shaft 6 via an oil hole opened in the driving shaft 6.

The electric motor portion 70 and the compression mechanism portion 80 are enclosed in the hermetic vessel 13 and are directly fixed to the hermetic vessel 13 by means of shrinkage fitting, welding, or the like.

In the compressor constructed as mentioned above, since the suction pressure atmosphere is kept in the hermetic vessel 13, the high-temperature high-pressure gas refrigerant does not flow back from the contact surface 21 between the cylinder 5 and the frame 19 and the contact surface 23 between the cylinder 5 and the cylinder head 20 to the low pressure side on which the evaporator 36 exists. A temperature rise of the condenser during an off period of operation can be prevented without installing a check valve or the like in the circuit.

A reciprocating type compressor can be mentioned as another example of the compressor in which the suction pressure atmosphere is kept in the hermetic vessel, the counterflow of the high-temperature and high-pressure gas refrigerant to the low pressure side on which the evaporator exists is prevented to avoid temperature rise of the condenser during an off period of operation, without installing a check valve or the like in the circuit. In comparison with the rotary compressor, a motor having a larger maximum torque is required in the reciprocating type compressor, in which (1) since a dead volume is large so that a dead volume loss is large, (2) a suction valve is necessary so that a suction pressure loss is large, (3) a discharge time is short (about a half of that of the rotary type) so that the discharge flow velocity is fast to cause a large discharge pressure loss, and (4) the compression torque fluctuates largely (about twice as large as that of the rotary type) so that a motor having a large maximum torque is necessary. The rotary type is more excellent from the viewpoint of the efficiency of the compression mechanism caused by the limited motor efficiency or the like.

In the conventional rolling piston type rotary compressor having a hermetic vessel with the suction pressure atmosphere in order to prevent the back flow of the gas refrigerant to the evaporator side to avoid the temperature rise of a condenser during an off period of operation while taking the advantage of high efficiency of the rotary type, the force by the differential pressure between the compression chamber and the hermetic vessel is applied to the vane in the direction of separating the vane away from the piston. Therefore, it is necessary to set the pressing force of the vane spring to a large value. When the compressor is started in the pressure balanced state, the pressing force of the vane spring is applied as it is without being cancelled out by the differential pressure so that the vane is pressed against the piston with a force larger than a pressing force necessary during the steady operation and an excessive load is applied on the piston. Consequently, a motor having a large starting torque is necessary for starting so that improvement for high efficiency of the motor is limited.

Since the pressing force of the vane spring which is always applied to be vane is set to be large, the sliding conditions between the tip of the vane and the peripheral surface of the piston becomes severe to cause not only wear of the tip of the vane but also generation of sludge. Since the suction pressure atmosphere is kept in the hermetic vessel, the generated sludge is exhausted through the discharge pipe to the circuit without being captured in the space in the hermetic vessel and deposited in the circuit to cause an inconvenience such as a choke of a capillary tube.

Figure 6:
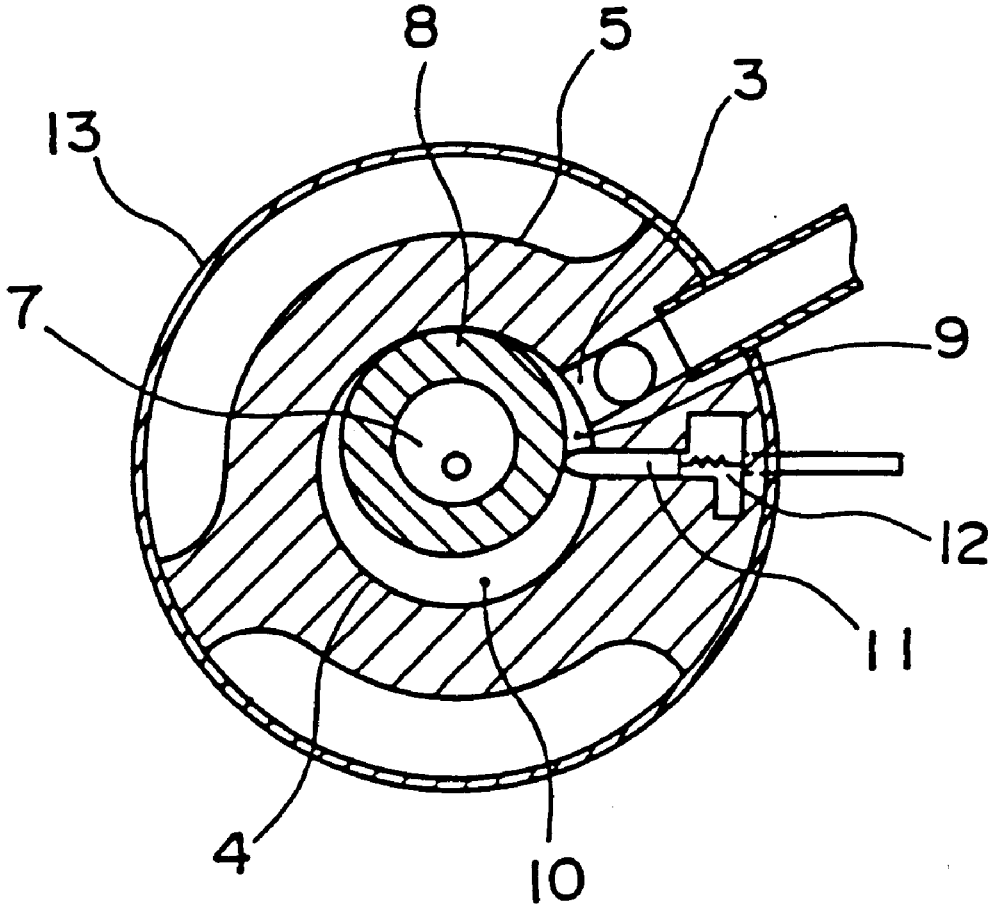
FIG. 6 (PRIOR ART)
FIG. 6 shows a transverse cross section of a compression mechanism portion of the conventional rotary compressor.
Figure 7:
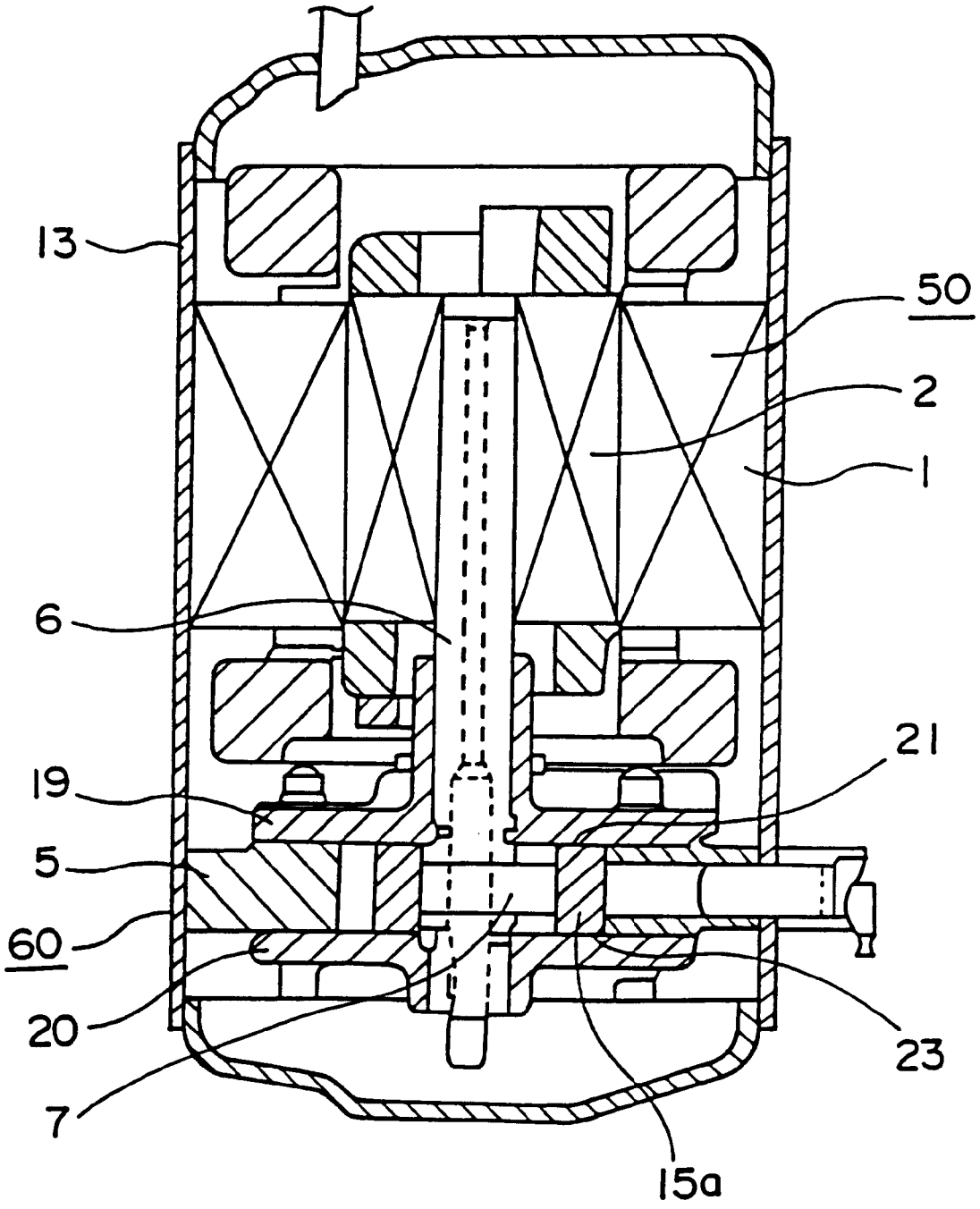
FIG. 7 (PRIOR ART)
FIG. 7 shows a longitudinal cross section of a conventional blade-integrated rotary compressor.
Figure 8:
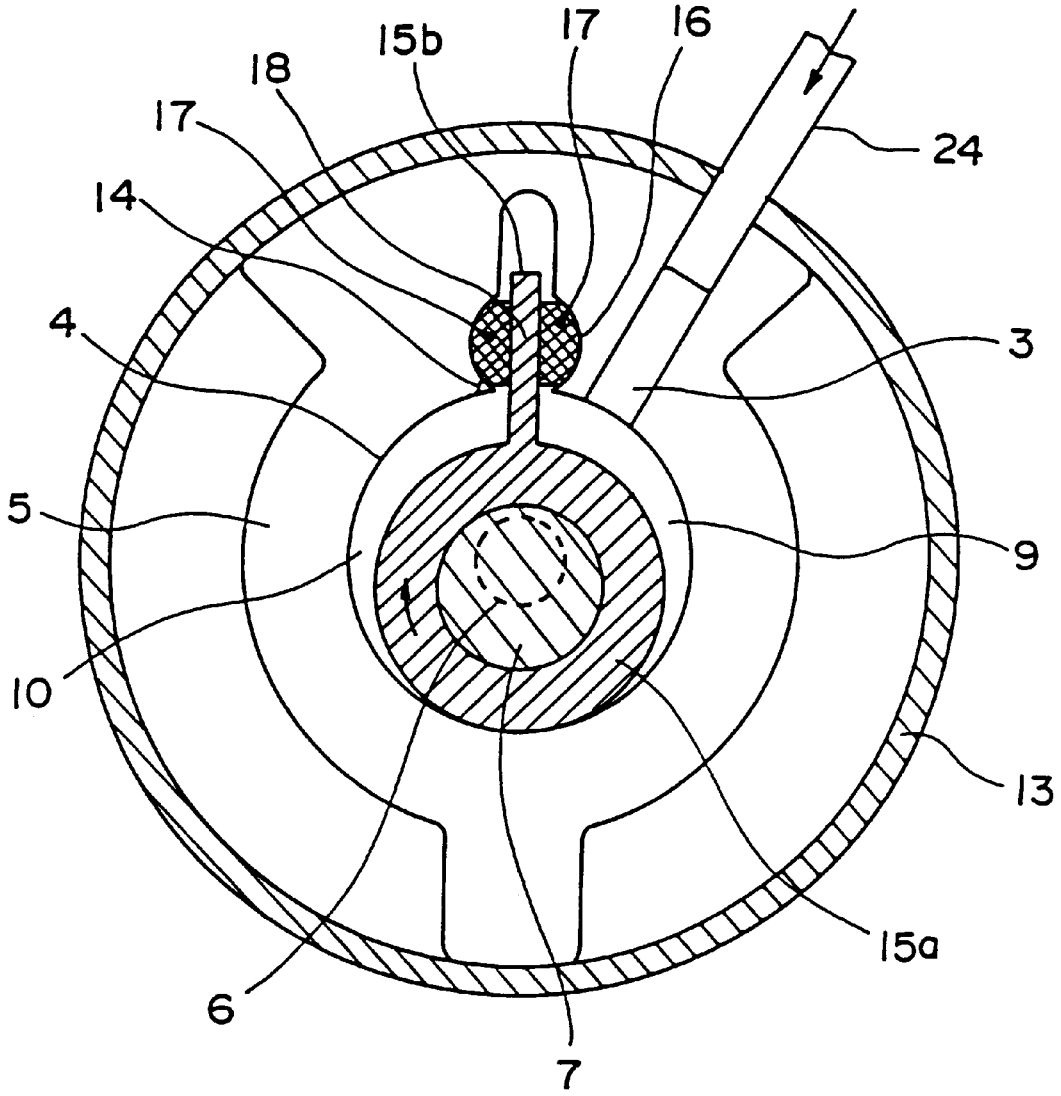
FIG. 8 (PRIOR ART)
FIG. 8 shows a transverse cross section of a compression mechanism portion of the conventional blade-integrated rotary compressor.

In the embodiment, the vane spring 12 for pressing the vane 11 against the piston 8 as shown in FIG. 6 of the conventional technique is unnecessary since the piston 15*a* and the blade 15*b* are integrally formed. Therefore, it is possible to avoid a decreased motor efficiency caused by an unstable starting due to an excessive pressing force of the vane spring 12 or by setting of the starting torque to an excessively large value. It is further possible to suppress generation, inflow to the circuit and deposition, of sludge, because the severe conditioned sliding portion between the tip of the vane and the piston peripheral surface is eliminated.

Figure 3:
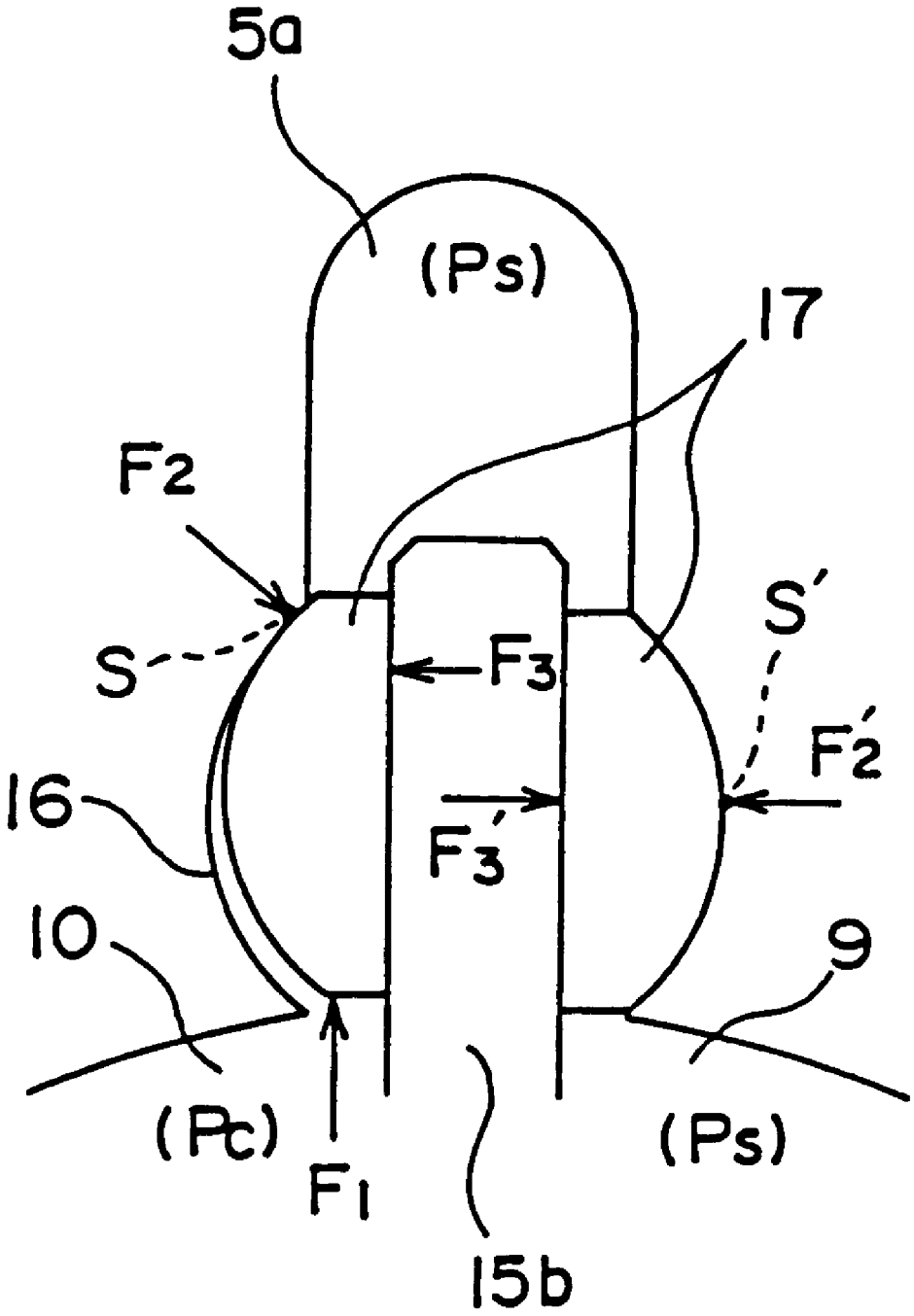
FIG. 3 shows a schematic diagram showing the relation of forces applied on a guide when a blade moving space of the rotary compressor in Embodiment 1 of the present invention is opened to a hermetic vessel in a suction pressure atmosphere.
Figure 11:
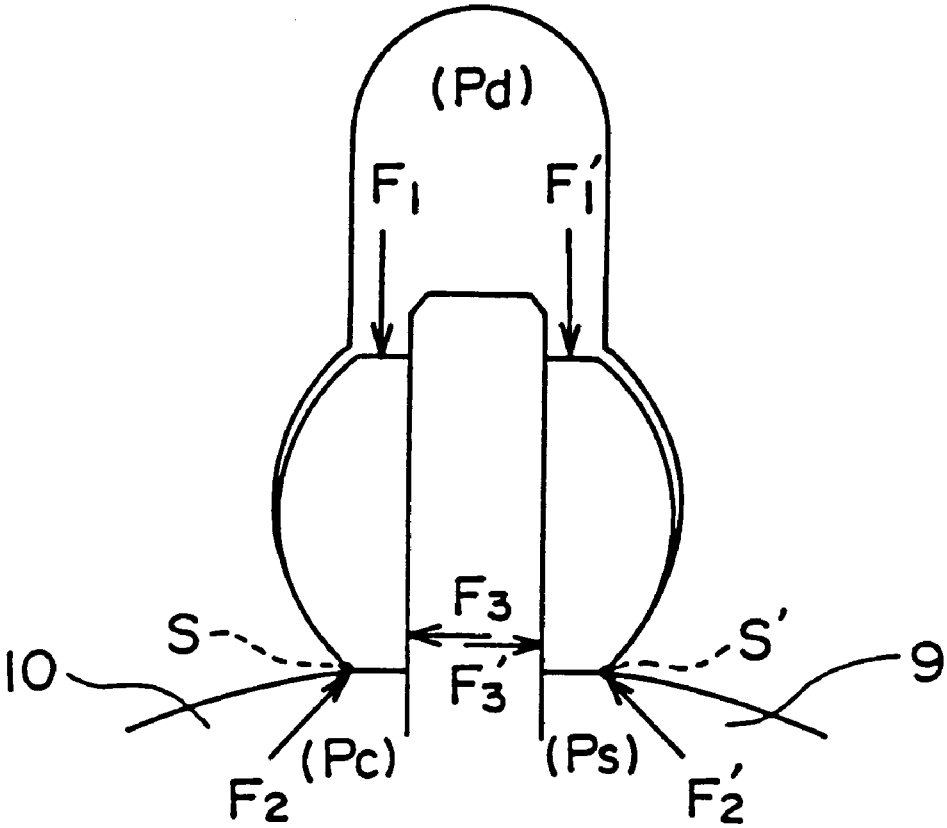
FIG. 11 shows a schematic diagram showing the relation of forces applied on the guide when the blade moving space is opened to the hermetic vessel in the discharge pressure atmosphere.
Figure 12:
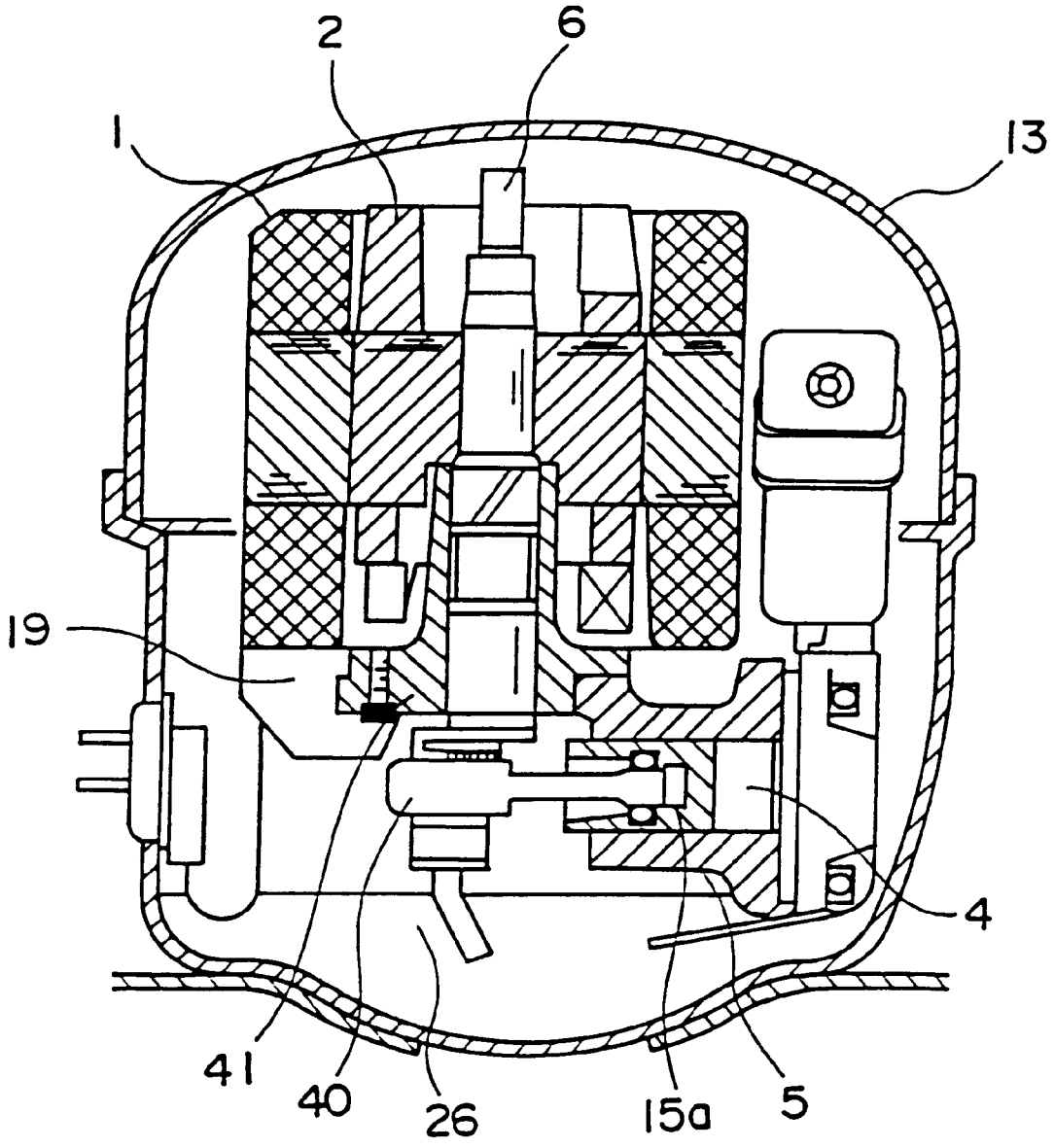
FIG. 12 shows a longitudinal cross section of a reciprocating type compressor.

Since the blade moving space 5*a* is opened to or communicating with the hermetic vessel 13 in the suction pressure atmosphere, the pressure in the blade moving space 5*a* becomes the suction pressure Ps and is lower than the pressure Pc in the high pressure chamber 10 and is almost equal to the pressure in the low pressure chamber 9. As shown in FIG. 3, the supporting point S of the guide 17 on the discharge side is a point near the blade moving space 5*a* and the supporting point S' of the guide 17 on the suction side is a point around the center of the guide. The load is not concentrated on a narrow range as shown in FIG. 11, so as to suppress the deterioration in reliability due to increase in the sliding loss between the side surface of the blade 15*b* and the flat portion of the guide 17 does not occur.

By the above mentioned effects, an improved efficiency, an improved reliability and a long life of the compressor can be assured and a reduction in cost of the refrigerating cycle using the compressor can be expected.

Embodiment 2

Figure 4A:
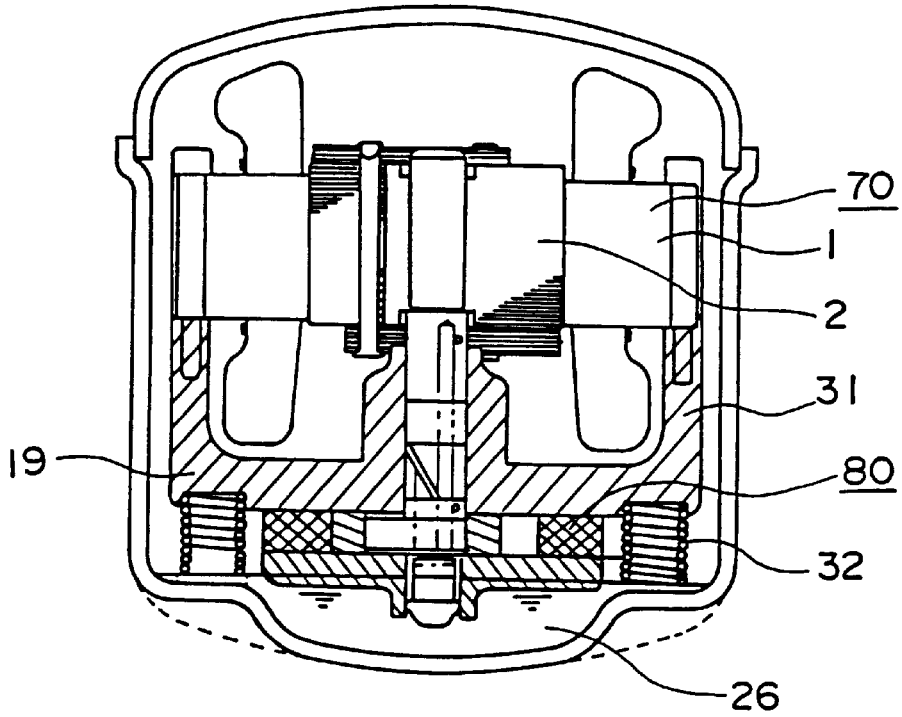
FIG. 4A is a longitudinal cross section of a blade-integrated piston type compressor of Embodiment 2, showing an elastic supporting member.
Figure 4B:
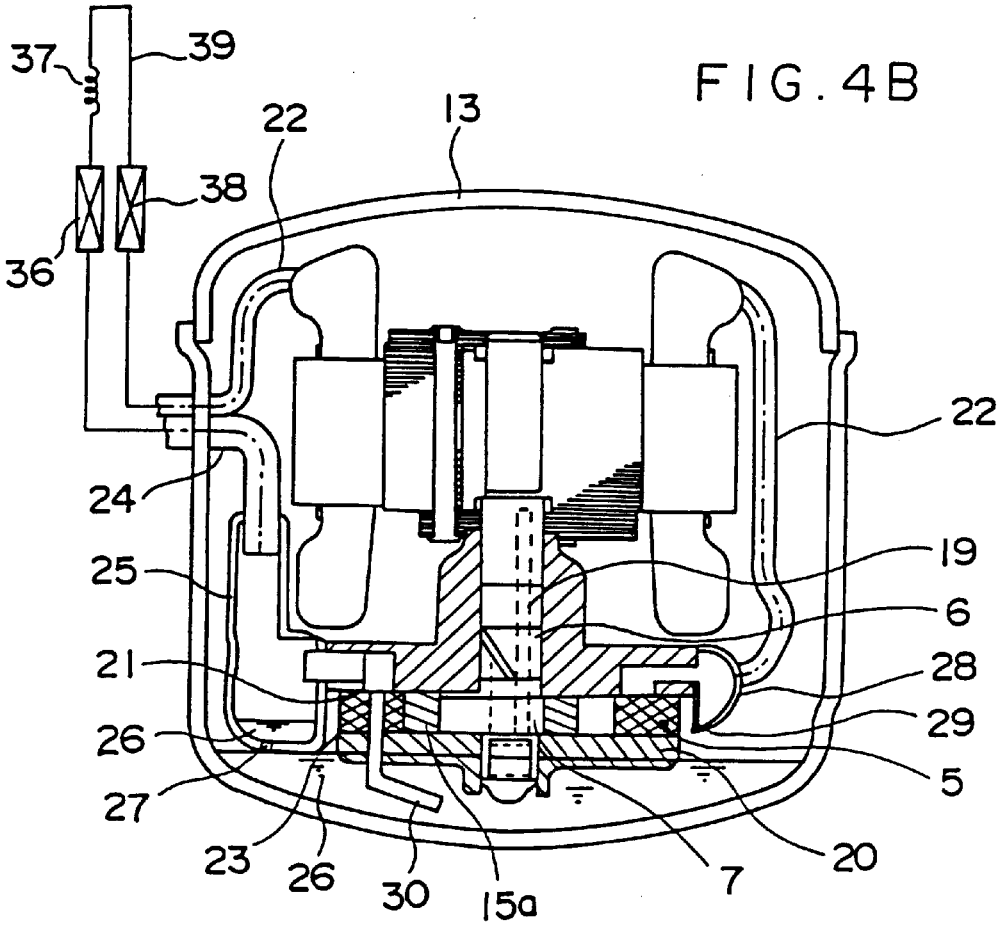
FIG. 4B is a longitudinal cross section and a diagram of a refrigerating cycle of the compressor of Embodiment 2, showing a suction route and a discharge route.
Figure 5:
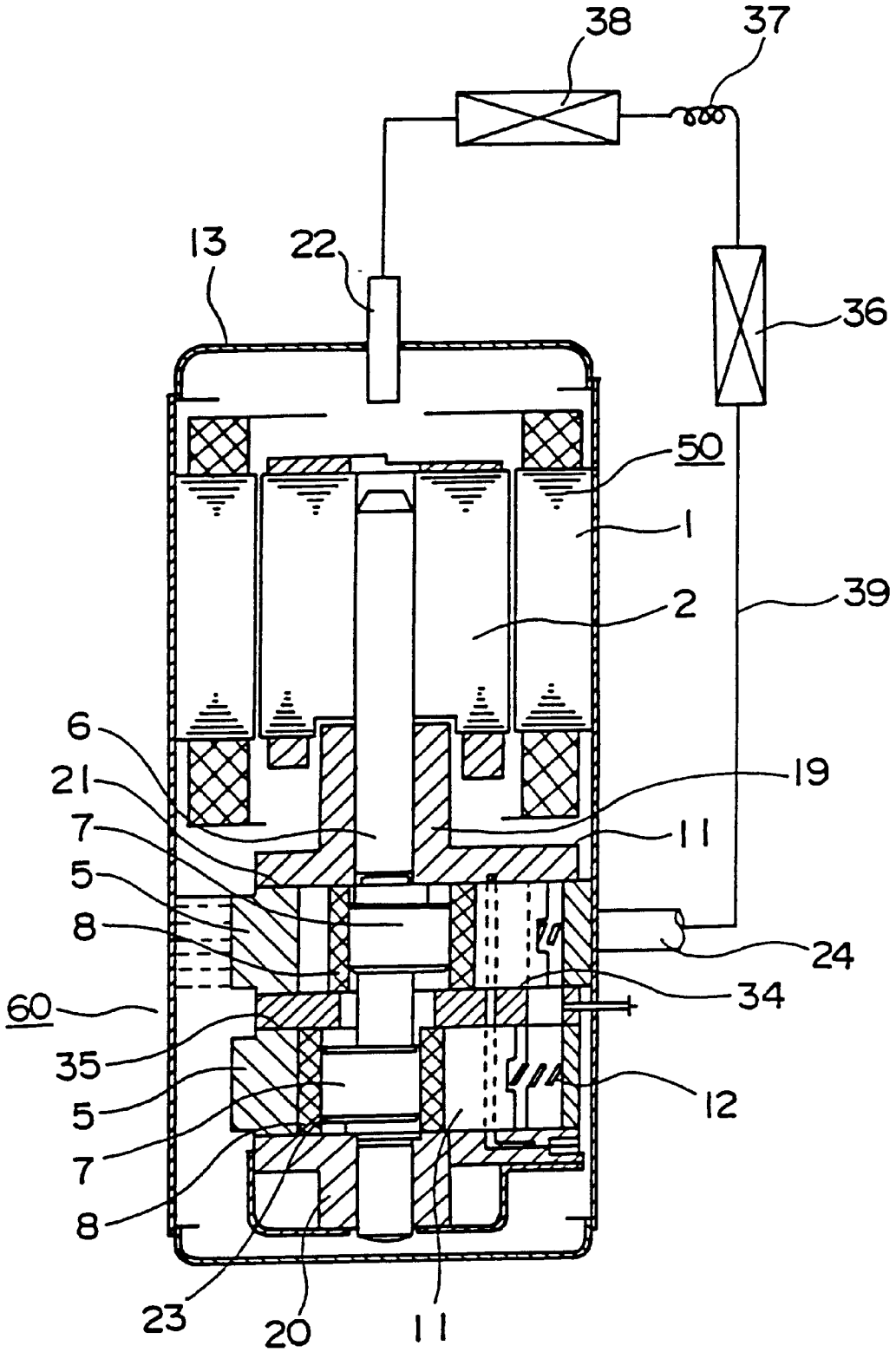
FIG. 5 (PRIOR ART)
FIG. 5 shows a longitudinal cross section of a conventional rotary compressor and a diagram of a refrigerating cycle.

In this embodiment, the same components as those of the abovementioned Embodiment 1 are designated by the same reference numerals and their description is omitted. The characteristic portion of the embodiment will be described. FIG. 4A is a longitudinal cross section of a blade-integrated piston type compressor of the embodiment, showing an elastic supporting member, and FIG. 4B is a longitudinal cross section of the compressor of the embodiment, showing a suction route and a discharge route, and a diagram of a refrigerating cycle. In FIGS. 4A and 4B, the blade-integrated piston type compressor comprises the electric motor portion 70 having the stator 1 and the rotor 2 and the compressor mechanism portion 80 driven by the electric motor 70. In a manner similar to FIG. 2 of Embodiment 1, the compression mechanism portion 80 comprises the cylinder 5 having the cylinder chamber 4 to which the suction port 3 and the discharge port 14 are opened, the piston 15*a* which is rotatably fit on the eccentric shaft portion 7 of the driving shaft 6 and disposed in the cylinder 5, the blade 15*b* which is provided integrally with the piston 15*a* and partitions the cylinder chamber 4 into the low pressure chamber 9 communicating with the suction port 3 and the high pressure chamber 10 communicating with the discharge port 14, and the guide 17 which is rotatably fit in the cylindrical bore 16 formed in the cylinder 5 and slidably and swingably supports the blade 15*b*. The piston 15*a* revolves along the inner wall of the cylinder chamber 4 in accordance with the rotation of the driving shaft 6 so as to swing as a fulcrum via the blade 15*b* on the axis center position 18 of the guide 17. A refrigerant gas sucked through the suction port 3 is compressed every revolution and discharged via the discharge port 14. In FIG. 4B, the refrigerant gas flowing through the suction pipe 24 is separated into the refrigerant gas and the lubricating oil 26 by the suction muffler 25. The separated lubricating oil 26 is returned via the bore 27 opened in the suction muffler into the hermetic vessel 13 and only the refrigerant gas is taken from the suction port 3 into the compression chamber. The compressed refrigerant gas is discharged via the discharge port 14, the pulsation of the refrigerant gas is suppressed by the discharge muffler 28, and the refrigerant is discharged through the discharge pipe 22 to the refrigerating cycle. These structures are the same as those of Embodiment 1.

The refrigerant gas flowing from the suction pipe 24 passes through the suction route and reaches the suction port 3. A pressure loss occurs when the refrigerant gas passes through the suction route. The pressure in the hermetic vessel 13 therefore becomes higher than that at the suction port 3. The injector pipe 30 for supplying the lubricating oil 26 into the compression chamber by using the differential pressure between the compression chamber and the hermetic vessel 13 is attached to the suction port 3. The lubricating oil 26 is supplied to the contact surface 21 between the cylinder 5 and the frame 19 and the contact surface 23 between the cylinder 5 and the cylinder head 20, thereby enhancing the sealing performance. Those are also the same as those in Embodiment 1.

The electric motor portion 70 and the compression mechanism portion 80 are enclosed in the hermetic vessel 13 and the stator 1 is bolted to legs 31 of the frame 19 projected in the axial direction from the compression mechanism portion 80 toward the electric motor portion 70. In this case, the number of the legs 31 of the frame 19 is set to three or more so that a connecting surface with the stator 1 can be determined. The frame legs 31 take the shape of legs projecting from the other portion of the frame 19, thereby having a flexible structure which is easily deformed. Such frame legs 31 are integrally formed with or properly connected to the other portion of the frame so that distortion or deformation of the frame legs 31 which occurs due to difference in shape of the stator 1 when the stator is bolted on the leg is not transmitted to contact portion of the frame 19 with the piston 15*a* and the cylinder 5 (difference in the axial dimension of the stator occurs due to uneven thickness of the layered steel plate serving as the iron core of the stator). Even if there is difference in the shape of the stator 1, the contact portion of the frame 19 with the piston 15*a* and the cylinder 5 keeps flat so that wear, input increase, leak, and the like do not occur.

In the blade-integrated piston type rotary compressor constructed as mentioned above, the vane 15*b* and the piston 15*a* are integrally formed. Consequently, the vane spring 12 for pressing the vane 11 against the piston 8 is unnecessary so that it is possible to avoid a decreased motor efficiency caused by an unstable starting due to excess pressing force of the vane spring 12 or by setting the starting torque to an excessively large value. It is further possible to suppress generation, inflow to the circuit and deposition, of sludge, because the severe conditioned sliding portion between the tip of the vane and the peripheral surface of the piston is eliminated. Since the suction pressure atmosphere is kept in the hermetic vessel 13, the high-temperature high-pressure gas refrigerant does not flow back from the contact surface 21 between the cylinder 5 and the frame 19 and the contact surface 23 between the cylinder 5 and the cylinder head 20 to the low pressure side on which the evaporator 36 exists, and the temperature rise in the condenser during an off period of operation can be prevented without installing a check valve or the like in the circuit. By these effects, an improved efficiency, an improved reliability and a long life of the compressor can be assured and reduction in cost of the refrigerating cycle using the compressor can be expected.

The electric motor portion 70 and the compression mechanism portion 80 which are integrally formed as mentioned above are supported by the elastic supporting member 32 such as coil springs in the hermetic vessel 13 (FIGS. 4A and 4B relate to such a structure that the lower end of the frame 19 is supported by the hermetic vessel 13 with aid of) a plurality of elastic supporting members 32 and a clearance is created between the inner wall of the hermetic vessel 13 and both of the electric motor portion 70 and the compression mechanism portion 80 (a clearance is such that even when the electric motor portion 70 and the compression mechanism portion 80 vibrate, they do not collide with the inner wall of the hermetic vessel 13). Thus, the vibration and noise occurring in the electric motor portion 70 and the compression mechanism portion 80 are not easily transmitted to the outside so that low vibration and low noise in the compressor can be expected.

Although the coil spring has been mentioned as the elastic supporting member 32, it is obvious that the vibration and noise of the electric motor portion 70 and the compression mechanism portion 80 are not easily transmitted to the outside also by other elastic supporting members such as a plate spring and rubber, and low vibration and low noise in the compressor can be expected.

Since the electric motor portion 70 and the compression mechanism portion 80 are held by the elastic supporting member 32 in the hermetic vessel 13, the shape of the discharge pipe 22 can be made easily changed as a whole by laying the discharge pipe 22 from the portion connected to the discharge muffler 28 in the compression mechanism portion to the portion fixed with the hermetic vessel 13 in the hermetic vessel 13 so as not to be bought in contact with the inner wall of the hermetic vessel 13, that is, the pipe is formed in a shape having low rigidity as a whole to absorb the vibration of the compression mechanism portion 80 and the electric motor portion 70 in the hermetic vessel 13 and prevent easy transmission of the vibration to the outside.

On the other hand, while the suction pipe 24 is extended from a fixing portion of the hermetic vessel 13 into the hermetic vessel 13 and connected to the suction muffler 25, the suction pipe 24 can be loosely connected to the suction muffler 25 so as to permit the vibration of the compression mechanism portion 80 (it is possible since the suction pressure atmosphere is kept in the hermetic vessel 13).

Embodiment 3

Embodiment 3 of the present invention will now be described. A blade-integrated piston type rotary compressor of the embodiment is constructed in a manner similar to Embodiment 1 or 2 and uses an HFC refrigerant such as R134a as a refrigerant.

In the blade-integrated piston type rotary compressor constructed as mentioned above, the suction pressure atmosphere is kept in the hermetic vessel, so that the high-temperature high-pressure gas refrigerant does not flow back from the contact surface between the cylinder and the frame and the contact surface between the cylinder and the cylinder head to the lower pressure side on which the evaporator exists and the temperature rise in the condenser during an off period of operation can be prevented without installing a check valve or the like in the circuit. Further, since the vane and the piston are integrally formed, it is possible to avoid a decreased motor efficiency caused by an unstable starting or an increase in the starting torque due to an excessive pressing force of the vane spring, which is caused in the conventional rotary compressor can be avoided. Further, since there is no severe conditioned sliding portion between the tip of the vane and the peripheral surface of the piston any severe lubricating condition does not appear in the sliding portion even with an HFC refrigerant such as R134a containing no chlorine and having no extreme-pressure effect so that generation, inflow to the circuit and deposition of sludge can be suppressed. By these effects, an improved efficiency, an improved reliability and a long life of the compressor can be assured and, further, reduction in cost of the refrigerating cycle using the compressor can be expected.

Embodiment 4

Embodiment 4 of the present invention will now be described. A blade-integrated piston type rotary compressor of the embodiment is a compressor constructed in a manner similar to Embodiment 3, and a lubricating oil such as hard alkylbenzene (HAB) which is not miscible or is slightly miscible with the HFC refrigerant such as R134a is used as the lubricating oil 26 enclosed in the hermetic vessel 13.

In the blade-integrated piston type rotary compressor constructed as mentioned above, since the refrigerant does not dissolve in the lubricating oil, the viscosity of the lubricating oil is always maintained to be unchanged and supplied to the sliding portion. Consequently, abnormal wear, burning, and the like of the sliding portion hardly occur.

Embodiment 5

Embodiment 5 of the present invention will now be described. A blade-integrated piston type rotary compressor of the embodiment is constructed in a manner similar to Embodiment 1 or 2 and uses a hydrocarbon refrigerant (HC refrigerant) such as propane or isobutane as a refrigerant.

In the blade-integrated piston type rotary compressor constructed as mentioned above, since a suction pressure atmosphere is kept in the hermetic vessel, an enclosed amount of the refrigerant can be reduced as compared with a compressor using the discharge pressure atmosphere. Even if the enclosed refrigerant leaks out to a room or the like, it will not reach the explosion limit. As compared with a reciprocating type compressor in which the suction pressure atmosphere is kept in the hermetic vessel, the compression mechanism portion is disposed symmetrically, in the blade-integrated piston type rotary compressor, so that the space volume in the hermetic vessel can be suppressed more than the asymmetrical reciprocating type, and it is more advantageous from the viewpoint of reduction in the enclosed amount of the refrigerant. That is, in the embodiment, such a compressor can be obtained as can safely use, as the refrigerant, a hydrocarbon refrigerant exerting no adverse influence on the global environment without using a CFC refrigerant or an HCFC refrigerant containing chlorine as a substance which destructs the ozone layer and an HFC refrigerant having a high global warming coefficient can be obtained.

Further, for use in a refrigerator, this compressor is more easily installed in a machine room of the refrigerator since the size of the compressor is smaller than that of the reciprocating type compressor with an asymmetrical compression mechanism portion.

Embodiment 6

Embodiment 6 of the present invention will now be described. The blade-integrated piston type rotary compressor is constructed in a manner similar to Embodiment 5 and uses, as the lubricating oil 26 enclosed in the hermetic vessel 13, a lubricating oil such as fluorine or polyalkyleneglycol (PAG) which is not miscible with or is slightly miscible with a hydrocarbon refrigerant such as propane or isobutane.

In the blade-integrated piston type rotary compressor constructed as mentioned above, the dissolving amount of the hydrocarbon refrigerant such as propane or isobutane which is a combustible refrigerant, into the lubricating oil 26 can be suppressed to a small value. It is therefore unnecessary to enclose an excessive refrigerant in expectation of the dissolving amount of the refrigerant into the lubricating oil 26, so that the refrigerant enclosing amount can be reduced as a whole. Even if the enclosed refrigerant leaks out into a room, it will not reach the explosion limit.

Since the refrigerant is not dissolved in the lubricating oil 26, the viscosity of the lubricating oil 26 is always maintained to be unchanged and supplied to the sliding portion. Consequently, abnormal wear, burning, and the like of the sliding portion hardly occur.

Embodiment 7

Embodiment 7 of the present invention will now be described. A blade-integrated piston rotary compressor of the embodiment is a compressor constructed in a manner similar to Embodiment 3, and a lubricating oil such as ester oil which is miscible with the HFC refrigerant such as R134a is used as the lubricating oil 26 enclosed in the hermetic vessel 13.

In the compressor constructed as mentioned above, since returnability of the miscible lubricating oil circulating in the circuit is more excellent than that of non-miscible lubricating oil, viscosity of the lubricating oil can be increased so that sealing effect in the compression chamber by the oil is enhanced to decrease leakage loss.

Embodiment 8

Embodiment 8 of the present invention will now be described. A blade-integrated piston type rotary compressor of the embodiment is constructed in a manner similar to Embodiment 6 and uses, as the lubricating oil 26 enclosed in the hermetic vessel, a lubricating oil such as paraffin mineral oil or hard alkylbenzene (HAB) which is miscible with a hydrocarbon refrigerant such as propane or isobutane.

In the compressor constructed as mentioned above, since returnability of the miscible lubricating oil circulating in the circuit is more excellent than that of non-miscible lubricating oil, viscosity of the lubricating oil can be increased so that sealing effect in the compression chamber by the oil is enhanced to decrease leakage loss.

Embodiment 9

Embodiment 9 of the present invention will be now be described. As shown in FIGS. 1 and 2, any of the blade-integrated piston type rotary compressors described in Embodiments 1 to 8 is connected to a condenser 38, a decompressor 37, the evaporator 36, and the like by piping to construct a refrigerating cycle, thereby enabling a refrigerating apparatus or an air conditioning apparatus taking advantage of the characteristics of the compressor to be obtained.

Especially, when the refrigerating cycle is constructed by using the compressor and used as a refrigerator, a very efficient refrigerator in which the high-temperature high-pressure gas refrigerant does not flow back to the evaporator without installing a check valve or the like can be obtained by keeping the suction pressure atmosphere in the hermetic vessel 13 of the compressor. By supporting the electric motor portion 70 and the compression mechanism portion 80 of the compressor by the elastic supporting member 32, a low-vibration low-noise refrigerator is obtained. By using a hydrocarbon refrigerant as a refrigerant, a refrigerator which assures the safety and does not exert an adverse influence on the global environment can be obtained.

Further, when any of the compressors of the foregoing embodiments with an additional inverter function, and a hydrocarbon refrigerant as a refrigerant is used in a refrigerator, such an effect that the compressor for a refrigerator can be made smaller than a corresponding reciprocating type compressor is also produced.

We claim:

1. A blade-integrated piston type rotary compressor comprising:

a compression mechanism portion having a cylinder, including, a suction port formed in a cylinder chamber, a piston which eccentrically revolves in the cylinder, a blade which is integrally formed with the piston and partitions the cylinder chamber into a high pressure chamber and a low pressure chamber, and a driving shaft for revolving the piston;

an electric motor portion for rotating the driving shaft;

a hermetic vessel configured to house the compression mechanism portion and the electric motor portion and in communication with the suction port thereby to maintain an interior of the hermetic vessel at a suction pressure atmosphere; and a discharge port formed in the cylinder chamber and in direct communication with an exterior of said hermetic vessel.

2. A rotary compressor according to claim 1, wherein the compression mechanism portion and the electric motor portion are held in the hermetic vessel by an elastic supporting member, a clearance is provided between the compression mechanism portion and the inner wall of the hermetic vessel and a clearance is provided between the electric motor portion and the inner wall of the hermetic vessel.

3. A rotary compressor according to claim 1 or 2, further comprising:

a refrigerant.

4. A rotary compressor according to claim 3, wherein the refrigerant comprises an HFC refrigerant.

5. A rotary compressor according to claim 4, further comprising:

a lubricating oil which is no more than slightly miscible with the HFC refrigerant.

6. A rotary compressor according to claim 3, wherein the refrigerant comprises a hydrocarbon refrigerant.

7. A rotary compressor according to claim 6, further comprising:

a lubricating oil which is no more than slightly miscible with the hydrocarbon refrigerant.

8. A refrigerating cycle comprising a compressor, an evaporator, a decompressor, and a condenser, characterized in that the rotary compressor according to claim 1 is used as the compressor.

9. A refrigerating cycle comprising a compressor, an evaporator, a decompressor, and a condenser, characterized in that the rotary compressor according to claim 3 is used as the compressor.

10. A refrigerating cycle comprising a compressor, and an evaporator, a decompressor, and a condenser, characterized in that the rotary compressor according to claim 8 is used as the compressor.

11. A refrigerator comprising a compressor, an evaporator, a decompressor, and a condenser, characterized in that the rotary compressor according to claim 1 is used as the compressor.

12. A refrigerator comprising a compressor, an evaporator, a decompressor, and a condenser, characterized in that the rotary compressor according to claim 3 is used as the compressor.

13. A refrigerator comprising a compressor, an evaporator, a decompressor, and a condenser, characterized in that the rotary compressor according to claim 8 is used as the compressor.

* * * * *

UNITED STATES PATENT AND TRADEMARK OFFICE

CERTIFICATE OF CORRECTION

PATENT NO. : 6,210,130 B1
DATED : April 3, 2001
INVENTOR(S) : Masayuki Kakuda, et al.

It is certified that error appears in the above-identified patent and that said Letters Patent is hereby corrected as shown below:

Title page,
Item [54], column 1,

The title is listed incorrectly. Item [54] should read as follows:

-- [54] ROTARY COMPRESSOR WITH SUCTION PRESSURE HERMETIC VESSEL, REFRIGERATING CYCLE USING THE COMPRESSOR, AND REFRIGERATOR USING THE COMPRESSOR --

Item [30], the Foreign Application Priority Data is listed incorrectly. Item [30] should read as follows:

-- [30] Foreign Application Priority Data

Aug. 6, 1998 (JP) .....10-222759
Jun. 4, 1999 (JP) .....11-157550 --

Signed and Sealed this

Ninth Day of October, 2001

*Attest:*

Nicholas P. Godici

*Attesting Officer*

NICHOLAS P. GODICI
*Acting Director of the United States Patent and Trademark Office*